United States Patent [19]

Buand

[11] Patent Number: 5,018,733

[45] Date of Patent: May 28, 1991

[54] HANDGRIP FOR A RACKET FOR BALL GAMES

[75] Inventor: Thierry M. M. Buand, Nantes, France

[73] Assignee: S.A. Donnay International, Couvin, Belgium

[21] Appl. No.: 335,920

[22] Filed: Apr. 10, 1989

[51] Int. Cl.[5] ..... A63F 49/08

[52] U.S. Cl. ..... 273/75; 273/73 J

[58] Field of Search ..... 273/75, 73 J, 73 C, 273/67 D, 67 DA, 67 DB

[56] References Cited

U.S. PATENT DOCUMENTS

| | | | |
|---|---|---|---|
| 3,311,375 | 3/1967 | Onions | 273/75 |
| 3,489,031 | 1/1970 | Meier | 273/73 J |
| 4,537,399 | 8/1985 | Adam | 273/75 |

FOREIGN PATENT DOCUMENTS

| | | | |
|---|---|---|---|
| 2925629 | 1/1981 | Fed. Rep. of Germany | 273/73 J |
| 3625929 | 2/1988 | Fed. Rep. of Germany | 273/73 J |
| 2569567 | 3/1986 | France | 273/75 |
| 1510626 | 5/1978 | United Kingdom | 273/75 |

*Primary Examiner*—Benjamin Layno

*Attorney, Agent, or Firm*—Townsend and Townsend

[57] ABSTRACT

A handgrip is described for a racket for ball games in which the grip body is surrounded by a grip sleeve and a ventilation chamber is formed between the grip sleeve and the grip body. For the purpose of obtaining a substantial damping of vibrations and oscillations at the ball impact moment provision is made that the volume of the ventilation chamber is variable by the pressure forces which are exerted by the hand of the respective player during the game, and that at least a part of the openings provided in the grip sleeve from an induction and/or explusion opening for the airflow which is brought about by the volume changes.

10 Claims, 4 Drawing Sheets

HANDGRIP FOR A RACKET FOR BALL GAMES

The invention relates to a handgrip for a racket for ball games, in particular for tennis, squash and badminton rackets.

BACKGROUND OF THE INVENTION

It is already known to provide handgrips for rackets with channels in order to achieve a certain air cooling which is intended to counteract disturbing perspiration effects between the handgrip and hand of the particular player, and thus to improve the grip quality. It is also already known to mount a layer of elastic material between the grip body and the grip tape in order to achieve damping of the oscillations and vibrations which occur at the instant of hitting a ball and to counteract damage to the arm or joints of the players, in particular the feared tennis elbow.

These known solutions however leave something to be desired with regard to their effectiveness, and can moreover unfavorably influence the stability and the desired ideal weight distribution over the length of the racket.

SUMMARY OF THE INVENTION

The object of the invention is to develop a handgrip of the initially named kind in a simple manner which is economical to realize and without impairing the stability, weight or ideal weight distribution of the racket, in such a way that a particularly effective damping of oscillations and vibrations is achieved and moreover, so that a ventilation is achieved which counters the occurrence of perspiration effects between the handgrip and the players hand, so that the security and quality of the grip are substantially improved for the player.

This object is satisfied essentially in that the volume of the ventilation chamber is variable by the pressure forces exerted during the game by the hand of the respective player; and in that at least a part of the openings provided in the grip sleeve form an induction and/or expulsion opening for an airflow which is also brought about by the volume changes.

Through this layout of the handgrip a pump effect which becomes effective prior to each strike of the ball necessarily results during the game, with a surprising vibration damping being achieved through cooperation of the air volume which is moved with the elements which ensure the radial elasticity of the grip sleeve. Moreover, an air circulation is achieved by the continuous pump effects which extensively hinders the perspiration effects and thus ensures a precise, firm and also comfortable gripping of the handgrip by the player.

The grip surface is preferably supported on the grip body by a plurality of spacer elements and the variability of the volume of the ventilation chamber is presettable via the elasticity of the grip sleeve and/or of the spacer elements. By suitable positioning of the spacer elements the radial elasticity over the length of the grip can be intentionally preset in this manner.

In accordance with an advantageous development of the invention the grip sleeve has extensions or projections which extend up to the racket head at the forehand side and at the backhand side, with air inlet and/or outlet openings which communicate with the ventilation chamber being formed in the extensions or projections, and with these openings in turn having an opening cross-section which is several times larger than the openings present in the grip sleeve associated with the actual grip region.

Through the comparatively large area air inlet and/or air outlet openings it is ensured that the high speeds of movement of the racket are exploited during both forehand and backhand strikes in order to promote the air movement or air exchange in the ventilation chamber, since during these strike movements the pressure at the openings on which flow is incident rises substantially in comparison to the openings disposed at the respective rearside and the pressure difference promotes the desired throughflow.

Further particularly advantageous layouts of the invention are set forth in the subordinate claims.

BRIEF DESCRIPTION OF THE DRAWINGS

The invention will now be explained in more detail with reference to embodiments and to the drawing; the drawing shows.

DESCRIPTION OF THE PREFERRED EMBODIMENT

Figures 1, 2, 3:
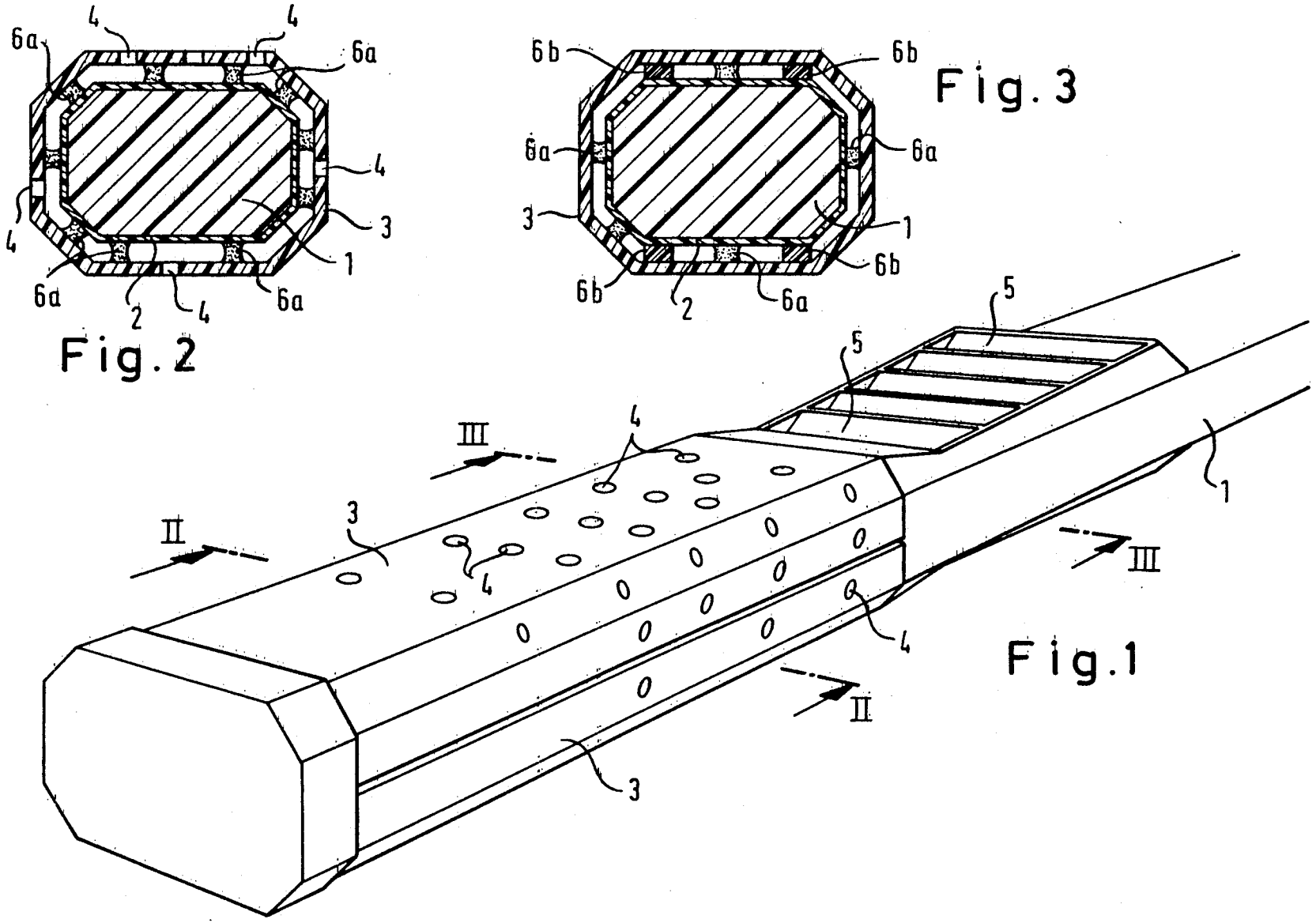
FIG. 1 a schematic perspective illustration of a racket handgrip constructed in accordance with the invention, FIG. 2 a cross-sectional representation in accordance with the section line A—A' of FIG. 1, FIG. 3 a cross-sectional view corresponding to the section line B—B' of FIG. 1, FIG. 4 a partially sectionally illustrated representation of a preferred embodiment of a racket handgrip in accordance with the invention.

A handgrip for sport rackets in accordance with the invention which is characterized by vibration damping characteristics and also characteristics which counteract perspiration in the grip region comprises a grip body 1, an inner sleeve 2 and an outer sleeve 3 coaxial thereto, with holes or slots 4 being provided in the outer sleeve 3. Spacer elements 6*a*, 6*b*, are provided between the outer sleeve 3 and the inner sleeve 2. These spacer elements 6*a*, 6*b*, support the outer sleeve 3 relative to the inner sleeve 2 or directly against the grip body 1 when operating without an inner sleeve 2.

Special air entry openings 5 which communicate with the ventilation chamber 8 formed between the outer sleeve 3 and the grip body 1 are provided at the racket head end in the outer sleeve 3 which preferably consists of two half shells. A grip tape which is mounted on the outer sleeve 3 can be perforated in the customary manner and extends over the length of the outer sleeve 3 but not however over the openings 5 provided in the end region of the grip sleeve 3.

The grip sleeve 3 is matched in its cross-sectional shape, in particular to the cross-sectional shape of the grip body 1, this is however not a necessity. It is on the contrary also possible to select the outer contour of the grip sleeve 3 independently of the cross-sectional shape of the grip body 1 in order to ensure the best possible grip characteristics.

The openings 4 provided in the grip sleeve 3 could be circular and could also have the form of slots or oval openings and the air exchange which takes place via these openings 4 counteracts the formation of perspiration in the grip region and thereby likewise improves the quality and reliability of the respective player's grip.

As the perspective illustration of FIGs. 1 shows the grip sleeve 3 preferably consists of two identical half shells which are mutually spaced apart via the spacer elements *6a, 6b,* so that they can be moved towards one another on exertion of radial forces by the respective grip of the player, but are simultaneously guided on the grip body.

The grip sleeve 3 is provided both at the forehand side and also at the backhand side with an extension in which the air openings 5 are formed. These air inlet openings 5 are preferably of lamella shape and the lamella can be made directable.

The spacer elements *6b* shown in FIG. 3 preferably have the shape of ribs or webs which extend in the longitudinal direction of the handgrip, so that air guidance regions are provided between such ribs, between the inlet openings 5 and the ventilation chamber 8, which ensure that the ventilation chamber 8 is always effective over its entire length and no undesired shortening of the airflow paths takes place between the air inlet 5 and air exits via the openings 4.

Figure 4:
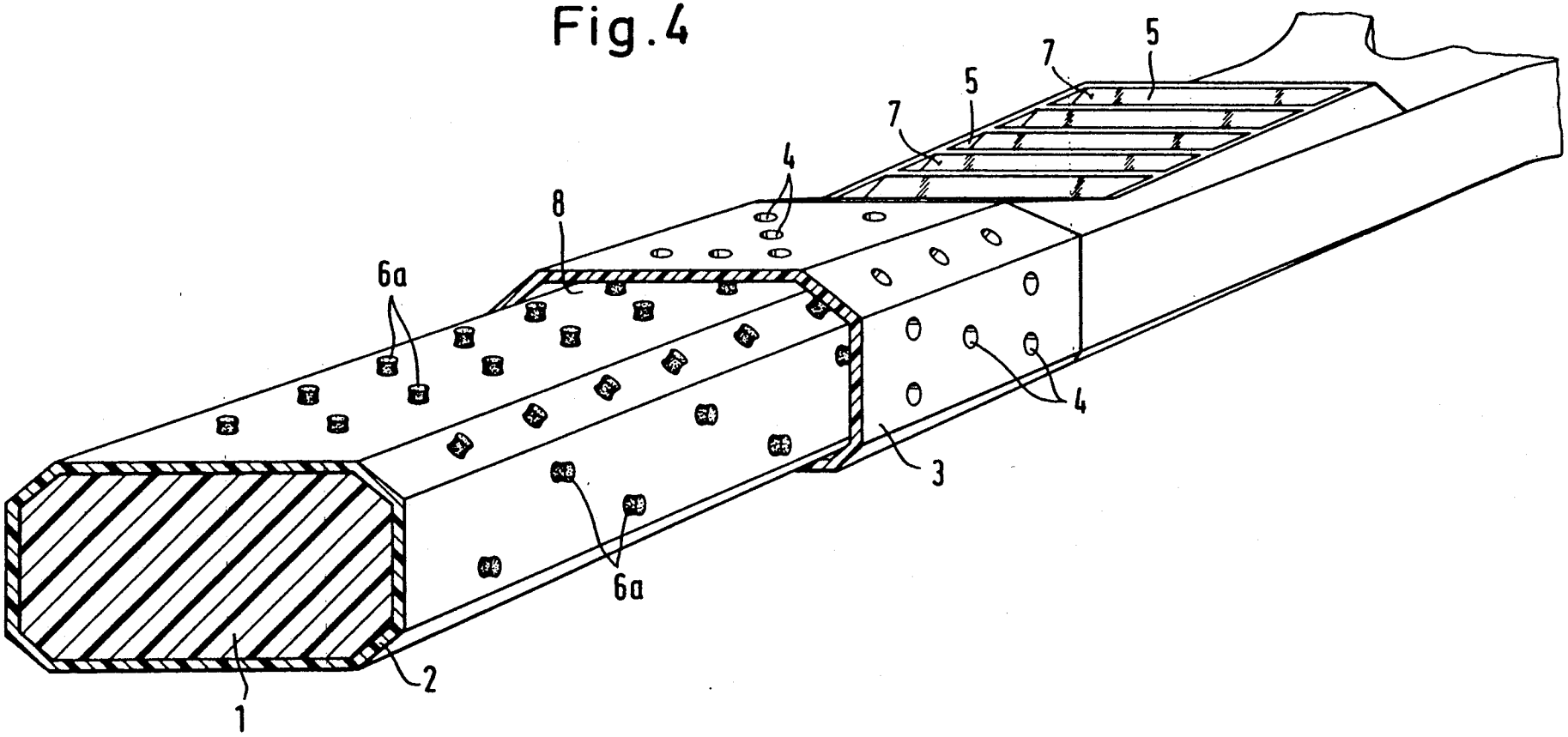
Figure 5A:
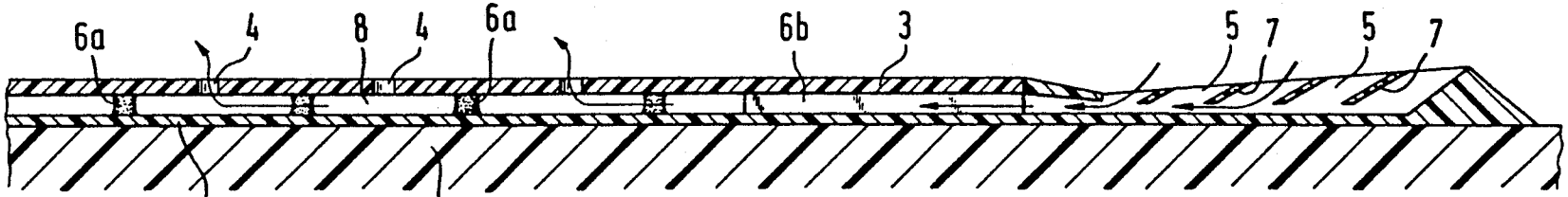
FIG. 5*a* is a partly broken away perspective view and FIG. 5*b* is a partly longitudinally sectioned view of a further embodiment of a racket handgrip in accordance with the invention, FIG. 6 a plan view of a specially formed air supply opening, and FIG. 7 a sectional view of the layout of the air supply opening of FIG. 6.
Figure 5B:
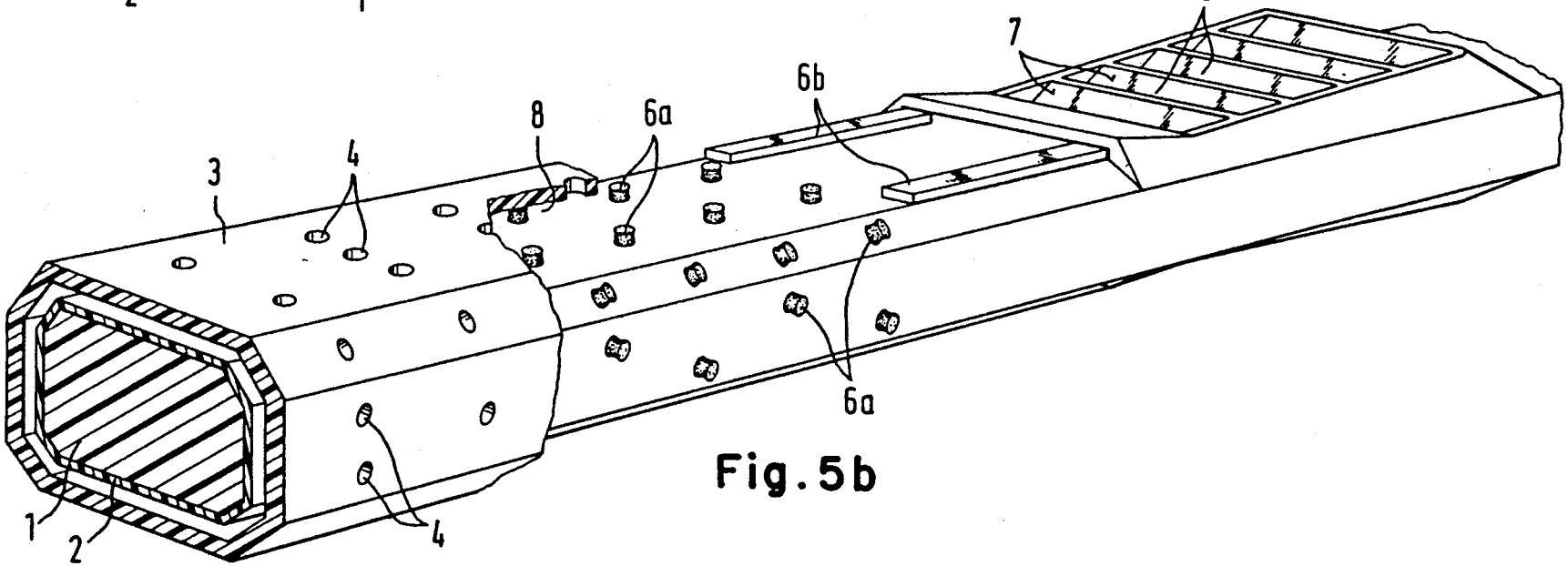

FIG. 4 shown an example for the layout of the spacer elements *6a* which can be preset in a defined manner with respect to the distribution and elasticity in dependence on the desired compression behavior of the grip sleeve 3. In the illustrated examples these spacer elements are molded onto the inner sleeve 2, so that an arrangement results which can be applied as a unit to the grip body 1.

In practice the inner sleeve 2 is however not absolutely essential since the spacer elements *6a* could also be directly braced against the grip body 1 and thus the ventilation chamber 8 formed directly between the grip body 1 and the grip sleeve 3. The spacer elements *6a* could also be attached to the inner side of the grip sleeve 3, or constructed in one piece therewith, and it is likewise possible to use separate support elements which are for example fixed by adhesive between the grip body 1 and the grip sleeve 3.

The extension parts of the grip sleeve 3 which extend up to the racket surface and which are provided at the forehand and backhand sides and contain the air inlet openings 5 can be made in one piece with the grip sleeve 3, can however also consist of separate parts which are optionally manufactured of a different material from the grip sleeve and which are then preferably fixed by clamping over the grip sleeve 3.

FIGS. *5a* and *5b* show an embodiment in which the air inlet openings are formed in the shape of lamella 7 and support elements *6b* in the grip region adjoining the air inlet openings have rib-like form and thus define together with the grip sleeve 3 an air guidance channel for connecting the air inlet openings 5 to the ventilation chamber 8.

Rib-like support elements can also be molded directly onto the inner surface of the grip sleeve 3 and it is possible by suitable positioning of such rib elements to achieve a desired air distribution within the ventilation chamber 8.

The support elements are in particular so arranged and their elasticity is so selected taking account of the inherent elasticity of the grip sleeve 3 that a pronounced pump effect results through volume change of the ventilation chamber 8 during the game, due to the pressure forces which are exerted by the hand of the respective player, and which are in particular increased before the ball impact moment. The airflow which is indicated by arrows in FIG. *5a* is also above all promoted by the racket movement, as a differential pressure which promotes the throughflow, and which is dependent on the racket speed, is built up in the inflow openings 5 which are provided at the forehand side and at the backhand side.

Figure 6:
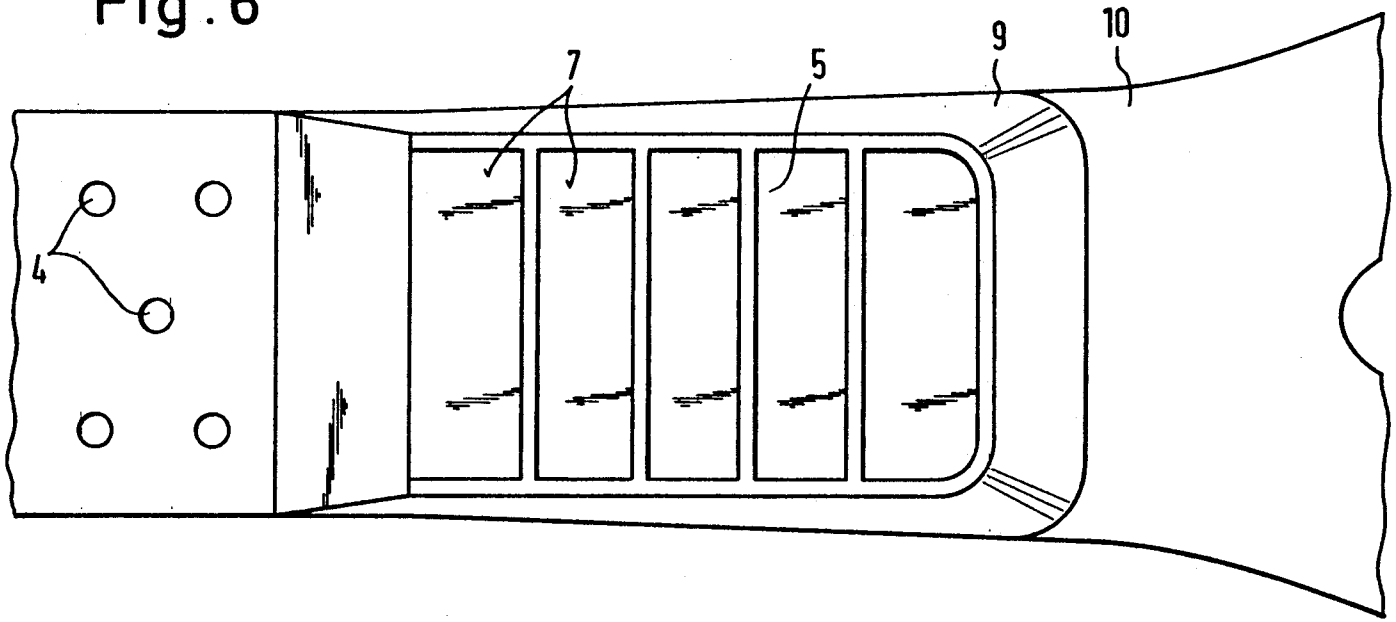
Figure 7:
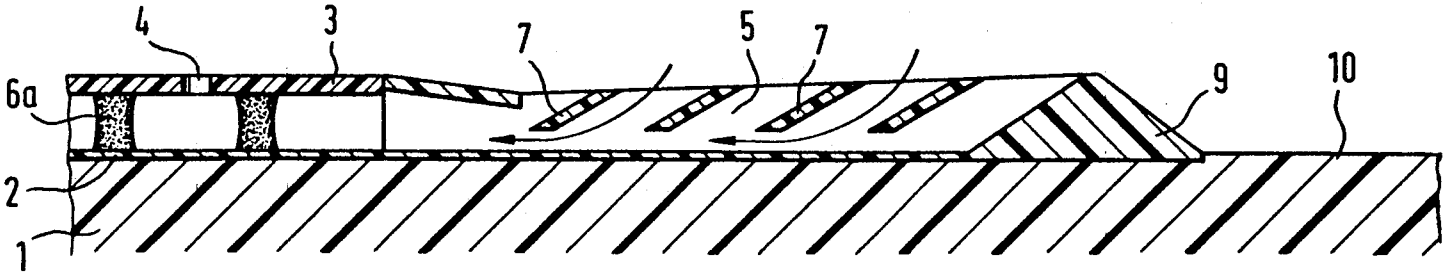

FIGS. 6 and 7 show a variant in which the air inlet openings 5 formed by the oblique lamella 7 are displaced through the grip sleeve projection part 9 close up to the racket head end of the grip body 10, with the air conveying components which are brought about by the incident flow speed being capable of being increased as a result of the plurality of air inlet openings.

In order to optimize the volume of the ventilation chamber 8 having regard to the volume changes that are desired it is possible to provide the grip body 1 with corresponding cut-outs at its flat sides, since the respectively desired outer contour of the handle can be preset in a defined manner by the grip sleeve 3 which is supported on the grip body 1, and thus corresponding modifications of the grip body 1 have no effect on the outer contour of the handgrip.

The grip sleeve 3 preferably consists f a plastic material, the radial elasticity of which can be influenced by the intentional introduction and layout of the holes 4. The overall radial elasticity of the handgrip is however preferably produced by the interplay of the grip sleeve which has a certain basic elasticity with the spacer elements of resilient material, for example spacer elements of rubber or rubber-like material which are provided between the grip body 1 and the grip sleeve 3. The function of the spacer elements can also be achieved by open celled foam material elements of suitable density.

Although the air induction openings 5 are preferably provided outside of the actual grip region and preferably at the racket head end it is also possible within the context of the invention to provide these air induction openings in the actual grip region or in the region of the end face of the hand grip, with the positioning being selected in such a way that the grip region which is important for the player is not impaired.

It has however been surprisingly shown that the layout of the handgrip in accordance with the invention for rackets for ball games not only increases the grip comfort, favors the attainment of a firm grip of the racket by the player and counteracts perspiration effects, but rather that above all a very important oscillation and vibration damping is achieved in the handgrip region, which is to a large part a consequence of the provision of an active air cushion in the handgrip region.

The handgrip in accordance with the invention can also be formed as a retrospectively fittable unit for customary grip bodies, for which purpose a radial broadening elasticity is preferably provided which ensures simple application of this handgrip to the grip body.

I claim:

1. Handgrip for a racket for ball games, in particular for tennis, squash and badminton rackets, the handgrip comprising a grip sleeve having a radial elasticity, said grip sleeve at least substantially surrounding the grip body, said grip sleeve supported on said grip body via a plurality of spacer elements, at least one ventilation chamber provided between the grip body and the grip sleeve and openings formed in the grip sleeve, wherein the volume of the ventilation chamber is variable by the pressure forces exerted during the game by the hand of the respective player; and in that at least a part of the openings provided in the grip sleeve form an induction and expulsion opening for an airflow which is also brought about by the volume changes, said variability of the volume of said ventilation chamber is presettable by said elasticity of the grip sleeve and of the spacer elements wherein the elasticity of the spacer elements is greater than the elasticity of the grip sleeve.

2. Handgrip in accordance with claim 1, wherein the spacer elements are at least partly formed in rib-like manner and form air conducting channels between the air entry and air outlet openings and the ventilation chamber.

3. Handgrip in accordance with claim 1, wherein the grip sleeve has extensions or projections which extend up to the racket head at the forehand side and at the backhand side with air inlet and air outlet openings which communicate with the ventilation chamber being formed in the extensions or projections.

4. Handgrip in accordance with claim 3, wherein the air inlet and air outlet openings have an opening cross-section which is several times larger than the openings provided in the grip sleeve.

5. Handgrip or a racket for ball games, in particular for tennis, squash and badminton rackets, the handgrip comprising a grip sleeve having a radial elasticity, said grip sleeve at least substantially surrounding the grip body, said grip sleeve supported on said grip body via a plurality of spacer elements, said grip sleeve is constructed in the form of two identical half shells which are attached to the grip body at a mutual spacing which is predeterminable by the spacer elements, at least one ventilation chamber provided between the grip body and the grip sleeve and openings formed in the grip sleeve, wherein the volume of the ventilation chamber is variable by the pressure forces exerted during the game by the hand of the respective player; and in that at least a part of the openings provided in the grip sleeve form an induction and expulsion opening for an airflow which is also brought about by the volume changes.

6. Handgrip in accordance with claim 1, wherein the grip sleeve has an outer contour corresponding to the customary grip contour irrespective of the cross-sectional shape of the grip body.

7. Handgrip for a racket for ball games, in particular for tennis, squash and badminton rackets, the handgrip comprising a grip sleeve having a radial elasticity, said grip sleeve at least substantially surrounding the grip body, said grip sleeve supported on said grip body via a plurality of spacer elements, distribution of the spacer elements is selected such that said radial elasticity of the grip sleeve has a maximum in the central grip region at least one ventilation chamber provided between the grip body and the grip sleeve and openings formed in the grip sleeve, wherein the volume of the ventilation chamber is variable by the pressure forces exerted during the game by the hand of the respective player; and in that at least a part of the openings provided in the grip sleeve form an induction and expulsion opening for an airflow which is also brought about by the volume changes.

8. Handgrip in accordance with claim 1, wherein an inner sleeve is associated with the grip sleeve and spaced therefrom via the spacer elements; and in that the inner sleeve, spacer elements and grip sleeve form a retrospectively fittable unit for conventional racket grips.

9. Ball game racket having a handgrip, said handgrip comprising a central grip body;

first and second shell elements disposed on opposite sides of said central grip body;

a plurality of resilient spacer elements defined between said shell elements and said grip body with said shell elements being positioned spaced from said grip body by said spacer elements to define a ventilation chamber between said shell elements and said grip body;

a plurality of ventilation openings formed in said shell elements and communicating between said ventilation chamber and in outside of said handgrip, said spacer elements having an elasticity greater than that of said shell elements and said shell elements being movable toward one another on exertion of radial forces by a player's grip on the handgrip to vary the volume of said ventilation chamber whereby to produce the pump effect for inducing and expelling air through said openings.

10. Handgrip for a racket for ball games, in particular for tennis, squash and badminton rackets, the handgrip comprising a grip sleeve which at least substantially surrounds a grip body, said grip sleeve supported on said grip body via a plurality of spacer elements, the distribution of said spacer elements selected such that the radial elasticity of said grip sleeve has a maximum in the central grip region;

at least one ventilation chamber provided between said grip body and said grip sleeve and openings formed in said grip sleeve, wherein the volume of said ventilation chamber formed between said grip sleeve and said grip body is variable by the pressure forces exerted during the game by the hand of the respective player, and in that at least a part of said openings provided in said grip sleeve form an induction and expulsion opening for an airflow which is also brought about by the volume changes produced by the pumping action of the player's hand.

* * * * *